US010626627B1

(12) United States Patent
Baynar, Jr.

(10) Patent No.: US 10,626,627 B1
(45) Date of Patent: Apr. 21, 2020

(54) CONTINUOUS CORNER POLE SYSTEM FOR MASONRY CONSTRUCTION

(71) Applicant: John F. Baynar, Jr., Westminster, MD (US)

(72) Inventor: John F. Baynar, Jr., Westminster, MD (US)

( * ) Notice: Subject to any disclaimer, the term of this patent is extended or adjusted under 35 U.S.C. 154(b) by 0 days.

(21) Appl. No.: 16/234,833

(22) Filed: Dec. 28, 2018

Related U.S. Application Data

(60) Provisional application No. 62/754,050, filed on Nov. 1, 2018.

(51) Int. Cl.
*E04G 21/18* (2006.01)

(52) U.S. Cl.
CPC ..... *E04G 21/1816* (2013.01); *E04G 21/1808* (2013.01); *E04G 21/1825* (2013.01)

(58) Field of Classification Search
CPC ..... E04G 21/1816; E04G 21/1808; E04G 21/1825; E04G 21/1841
See application file for complete search history.

(56) References Cited

U.S. PATENT DOCUMENTS 2,623,289 A * 12/1952 Kampel ..... E04G 21/1808 33/406
3,096,588 A * 7/1963 Cook ..... E04G 21/1808 33/406
4,631,833 A * 12/1986 Moye ..... E04G 21/1808 33/408
4,689,889 A * 9/1987 Reeves ..... E04G 21/1816 248/539
7,310,888 B2 * 12/2007 Gilliland ..... E04G 21/1808 33/404
8,141,830 B1 * 3/2012 Hudson ..... E04G 21/1808 248/188
8,826,555 B2 * 9/2014 Ruonavaara ..... E04G 21/1816 33/404
2011/0253954 A1 * 10/2011 Fortner ..... B66F 3/10 254/98
2011/0277330 A1 11/2011 Dumas
2012/0096806 A1 * 4/2012 Fransen ..... E04G 21/1816 52/749.14
2012/0097808 A1 * 4/2012 Ruonavaara ..... E04G 21/1808 248/125.3
2014/0345231 A1 11/2014 Oates
2016/0376797 A1 * 12/2016 Scott ..... E04G 21/1808 33/406
2017/0152670 A9 6/2017 Fransen
2018/0223525 A1 8/2018 Nir et al.

* cited by examiner

*Primary Examiner* — Joshua K Ihezie
(74) *Attorney, Agent, or Firm* — Stuart I. Smith; Roberts Calderon Safran & Cole, P.C.

(57) ABSTRACT

A construction system for establishing alignment of a plurality of masonry building units is provided. The system includes a base having a base plate, a vertical extension extending vertically from the base plate, the vertical extension having a first hole through the vertical extension, and a leveling mechanism that adjusts an orientation of the base plate relative to a surface on which the base is located; a first pole removably attached to the vertical extension, the first pole having a first end, a second end, and a first hole through the first pole proximate to the first end; and a first pin removably attaching the first pole to the vertical extension, the first pin being located in the first hole of the vertical extension and the first hole of the first pole.

18 Claims, 10 Drawing Sheets

CONTINUOUS CORNER POLE SYSTEM FOR MASONRY CONSTRUCTION

FIELD OF THE INVENTION

The invention is directed to a system for facilitating the construction of a masonry wall or shaft. More particularly, embodiments of the invention are directed to a system for setting and maintaining a reference for a corner of a masonry wall or shaft.

An example of an application for the invention is a corner pole system that sets a vertical reference line for a vertical corner of a masonry elevator, stair, or ventilation shaft.

BACKGROUND OF THE INVENTION

Some building projects include one or more masonry walls or shafts. For example, a project might include a cinder block stair shaft that extends vertically through multiple floors of the building. Traditionally, the construction of such shafts is very time consuming as compared to a straight wall because in a shaft there is very little straight construction relative to the amount of corner construction. Building corners in masonry requires repeated checking of level and alignment, and corners often establish the reference points from which the straight sections are built. As a result, productivity in corners is far less than productivity in straight sections.

Applicant recognized an improvement to the above arrangement and implements that improvement in embodiments of the invention.

SUMMARY

It is often desirable to build some masonry construction, such as, for example, elevator or stair shafts, before any other structure is built near the masonry construction. In these cases, there is no structure to which the top (or other part) of a corner pole can be secured. Embodiments of the invention are particularly useful in these situations. In some situations, use of the invention significantly increases productivity by providing a corner pole reference line where no securing structure other than the masonry wall itself is available.

The invention achieves the benefit of increasing productivity by providing a corner pole reference to which masons can lay masonry units without the need to repeatedly pick up a level and check the level and location of each masonry unit.

Particular embodiments of the invention are directed to a construction system for establishing alignment of a plurality of masonry building units. The system includes a base having a base plate, a vertical extension extending vertically from the base plate, the vertical extension having a first hole through the vertical extension, and a leveling mechanism that adjusts an orientation of the base plate relative to a surface on which the base is located; a first pole removably attached to the vertical extension, the first pole having a first end, a second end, and a first hole through the first pole proximate to the first end; and a first pin removably attaching the first pole to the vertical extension, the first pin being located in the first hole of the vertical extension and the first hole of the first pole.

Some embodiments include a second hole through the vertical extension, the second hole located vertically higher on the vertical extension than the first hole. The first pole has a first end and a second end, the first end being closer to the base plate than the second end when the first pole is attached to the vertical extension, the first end of the first pole is a first distance from the base plate when the first pin is in the first hole of the first pole and the first hole of the vertical extension, the first end of the first pole is a second distance from the base plate when the first pin is in the first hole of the first pole and the second hole of the vertical extension, and the second distance is larger than the first distance.

Other embodiments of the invention are directed to a base for a construction system for establishing alignment of a plurality of masonry building units. The base includes a base plate, a vertical extension extending vertically from the base plate, the vertical extension having a first hole through the vertical extension and a second hole through the vertical extension, and a leveling mechanism that adjusts an orientation of the base plate relative to a surface on which the base is located. The second hole is located vertically higher on the vertical extension than the first hole.

Other embodiments of the invention are directed to a method of aligning a plurality of masonry building units. The method includes providing a base having a base plate, a vertical extension extending vertically from the base plate, the vertical extension having a first hole through the vertical extension, and a leveling mechanism that adjusts an orientation of the base plate relative to a surface on which the base is located; removably attaching a first pole to the vertical extension with a first pin, the first pole having a first end, a second end, and a first hole through the first pole proximate to the first end, the first pin being located in the first hole of the vertical extension and the first hole of the first pole; positioning the base such that an edge of the first pole is a predetermined distance from a predetermined vertical surface of the plurality of building units; and leveling the base by adjusting the leveling mechanism such that the first pole is vertical. The first pole is secured at most to the base and the masonry building units.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As mentioned above, embodiments of the invention provide systems and methods to increase the productivity on shaft (or other masonry) construction.

Figure 1:
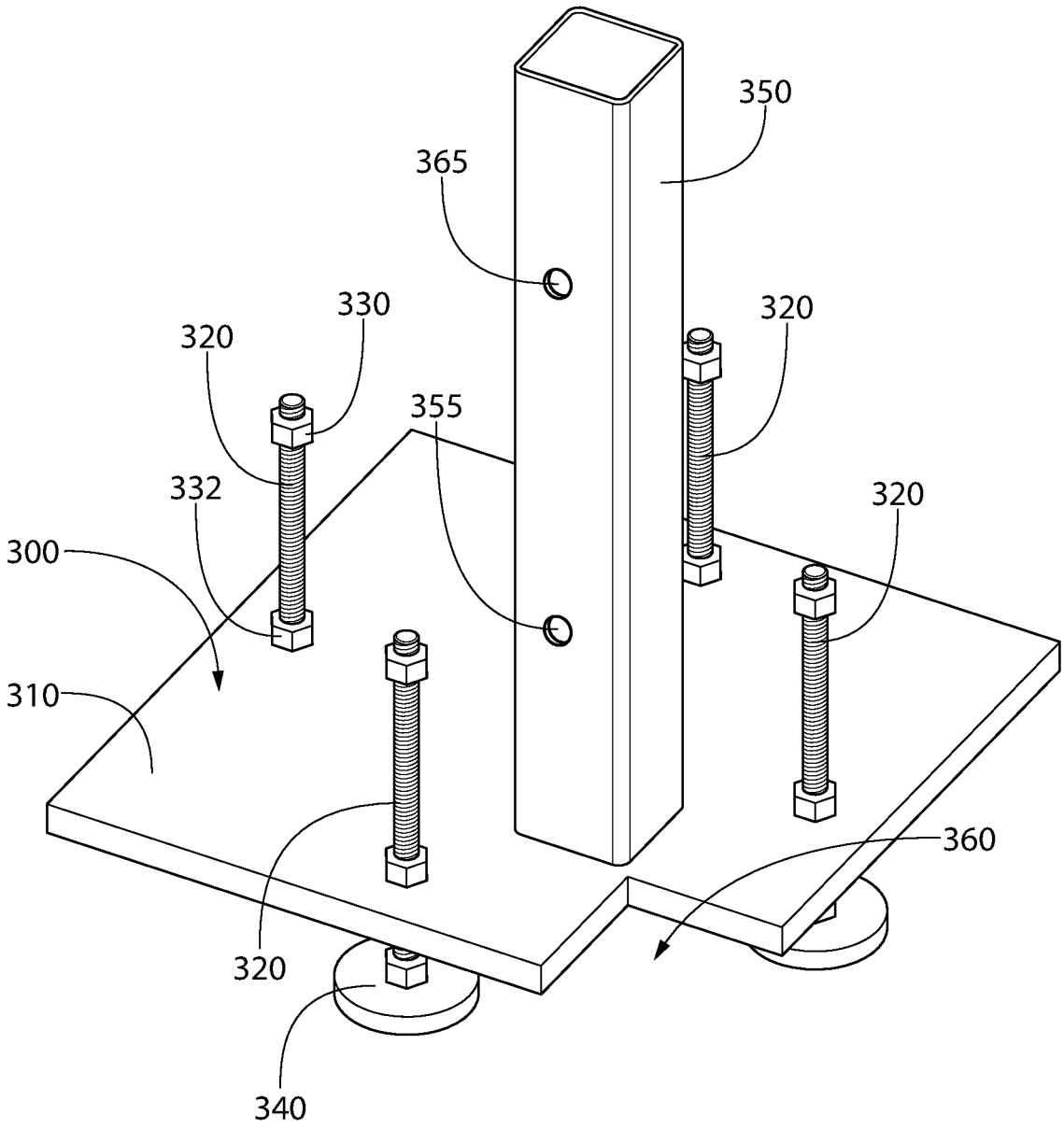
FIG. 1 is a perspective view of an exemplary base plate in accordance with embodiments of the invention.

FIG. 1 shows an example of a base 300 in accordance with embodiments of the invention. Base 300 is placed on a surface, such as, for example, a concrete slab, that is adjacent to a masonry wall that is to be constructed. A pole is then attached to base 300 such that the pole extends vertically to provide a vertical reference line that is used as a guide for laying the masonry units. While the examples discussed in this disclosure refer to the pole, or poles, being vertical, it is noted that in other embodiments the pole or poles can be angled to provide a particular desired reference line.

Base 300 has a base plate 310 that is, in this example, square with a square cut-out 360 located at one corner of base plate 310. A vertical extension 350 extends vertically (in this example) from base plate 310. In this example, vertical extension 350 has a square cross-section and is tubular. Other examples have a cross-section that is rectangular, triangular, or some other shape, and/or are solid. Cut-out 360 is provided to allow base 300 to be positioned close to, or touching, a corner of a masonry unit such that a corner of vertical extension 350 (or a pole placed over vertical extension 350) can be located close to, or touching, the corner of the masonry unit. The corner of vertical extension 350 and/or a corner of a pole attached to vertical extension 350 is used as a guide for placement of multiple masonry units in the construction of the masonry wall. While base plate 310 is square in this example, base plate 310 can be rectangular, triangular, or any other shape that is appropriate to support one or more poles.

The examples used to describe embodiments of the invention refer to the construction of a corner of a masonry wall. It is noted that embodiments of the invention can also be used to provide reference line (for example, a vertical reference line) for use at a point along a wall that is not a corner. When embodiments are used at a point other than a corner, base plate 310 is modified from the example shown to allow a corner (or some other part, such as a side) of vertical extension 350 and/or a pole attached to vertical extension 350 to be positioned close to or touching masonry units of the wall being constructed.

Base 300 is shown in FIG. 1 as having four leveling mechanisms that are used to level base plate 310 so that, in this example, vertical extension 350 is vertical. In some cases, the surface on which base 300 rests is not level and, as a result, a leveling mechanism built into base 300 is advantageous. In this example, each leveling mechanism includes a foot 340 that is attached to a threaded rod 320 that extends through a threaded hole (not shown) in base plate 310. A nut 330 is welded to an upper end of threaded rod 320 so that turning nut 330 turns threaded rod 320 and winds foot 340 either closer to or farther away from base plate 310. Threaded rod 320 is connected, in some embodiments, to foot 340 by a rotating joint so that foot 340 can rotate relative to threaded rod 320. A nut 332 is provided for locking threaded rod 320 in place relative to base plate 310. In other embodiments, threaded rod 320 and nut 330 are replaced by a bolt or other threaded one-piece member. In other embodiments, the hole in base plate 310 through which threaded rod 320 passes is not threaded and a series of nuts or other fasteners are used to maintain the desired relative vertical positions of base plate 310 and foot 340. Other embodiments use some other leveling mechanism that includes a non-threaded rod or other adjustment member. The example shown in FIG. 1 has four leveling mechanisms. Other examples have fewer or more leveling mechanisms and/or different locations of the leveling mechanisms.

FIG. 1 shows vertical extension 350 having an upper hole 365 and a lower hole 355. Upper hole 365 and lower hole 355 extend horizontally all of the way through vertical extension 350. In the example shown, vertical extension 350 is a tube and, as a result, upper hole 365 includes two holes 365 (one through each side of the tube) and lower hole 355 includes two holes 355 (one through each side of the tube). In some embodiments, vertical extension 350 is solid and, therefore, upper hole 365 is one continuous hole and lower hole 355 is one continuous hole. Upper and lower holes 365, 355 accept pins (described in more detail below) that hold a tube in place on vertical extension 350.

Figure 2:
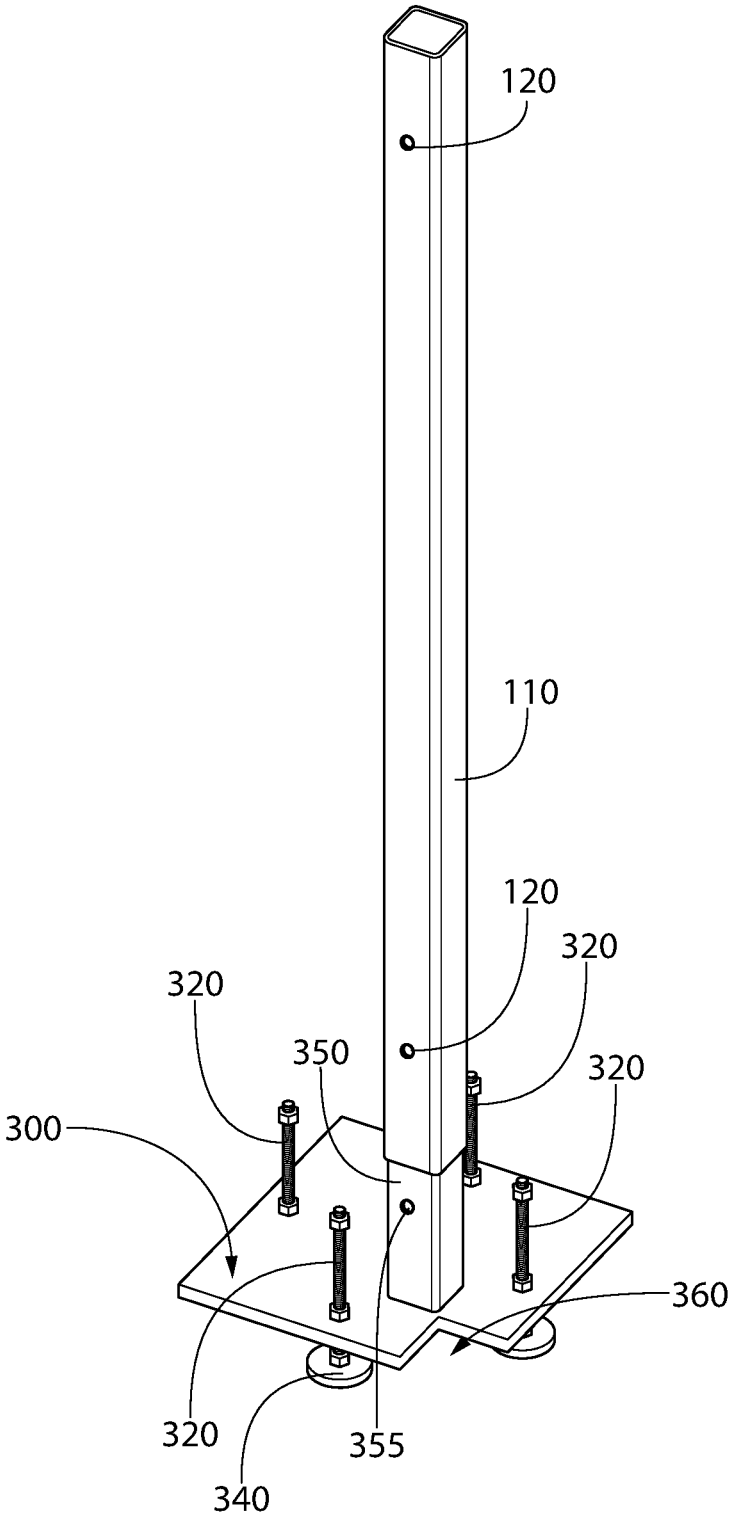
FIG. 2 is a perspective view of the base plate of FIG. 1 and a pole in an upper position in accordance with exemplary embodiments of the invention.
Figure 3:
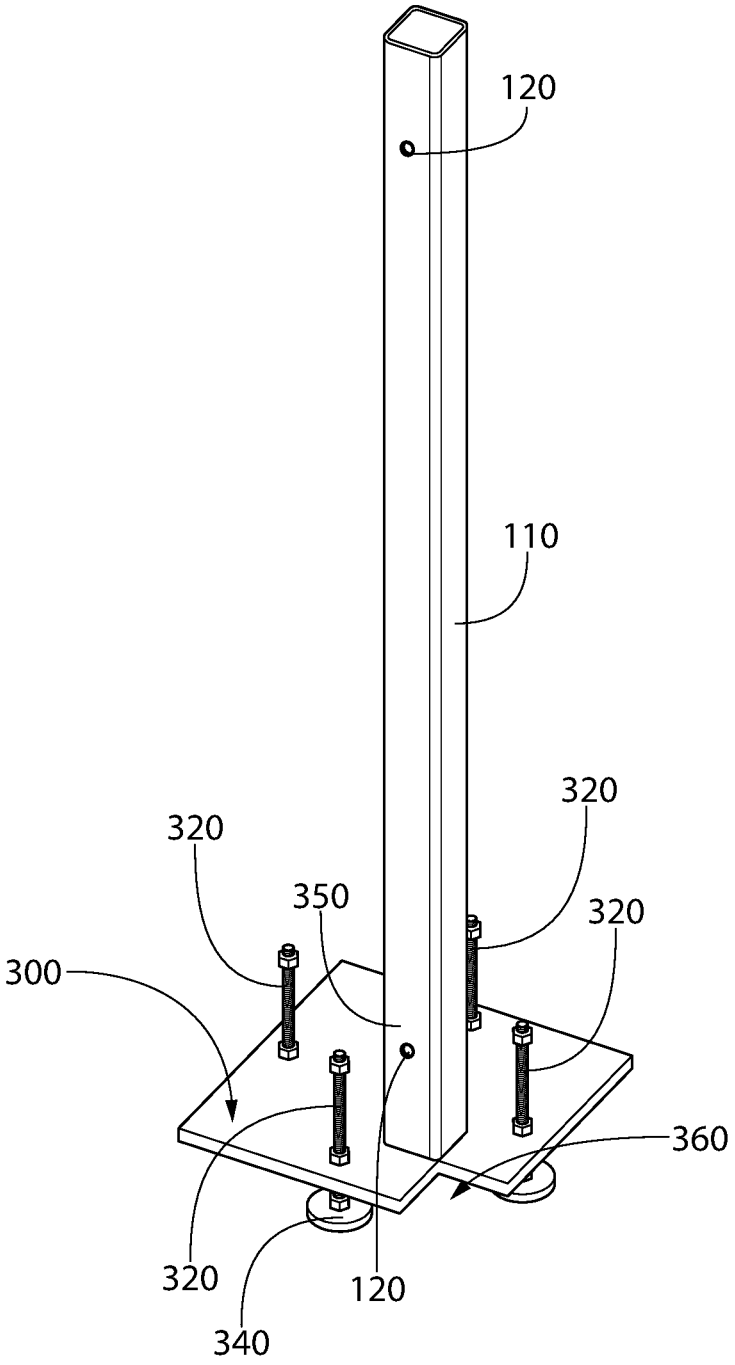
FIG. 3 is a perspective view of the base plate of FIG. 1 and a pole in a lower position in accordance with exemplary embodiments of the invention.
Figure 4:
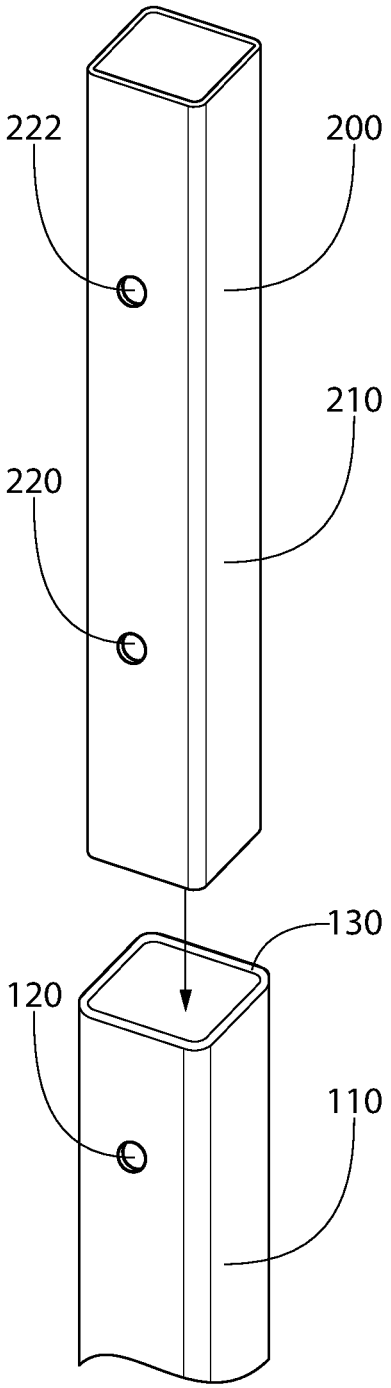
FIG. 4 is a perspective view of a pole and connector piece in accordance with exemplary embodiments of the invention.

FIGS. 2 and 3 show base 300 with a pole 110 attached to base 300. FIG. 2 shows pole 110 attached to base 300 at an upper position, whereas FIG. 3 shows pole 110 attached to base 300 at a lower position. Pole 110 is, in this example, tubular such that pole 110 slides over vertical extension 350. Pole 110 has a pair of holes 120 that align with each other on opposite sides of the tubular shape of pole 110. In FIG. 2, a pin (not shown) extends through one hole 120, through upper hole(s) 365, and through the other hole 120 to attach pole 110 to vertical extension 350 in the upper position. In FIG. 3, the same pin (not shown) extends through one hole 120, through lower hole(s) 355, and through the other hole 120 to attach pole 110 to vertical extension 350 at the lower position. A pin such as pin 450 shown in FIG. 5 can be used. A cotter pin (such as cotter pin 460 shown in FIG. 7), wire, or other fastener can be used to keep the pin in the holes. A purpose of having the upper and lower positions of pole 110 will be described in detail below.

Vertical extension 350 is sized to fit inside tube 110 so that tube 110 moves, at most, only slightly side-to-side relative to vertical extension 350. In some embodiments, tube 110 cannot move relative to vertical extension 250 in any direction other than sliding on to or off of vertical extension 350. A snug fit between the inside of tube 110 and the outside of vertical extension 350 keeps tube 110 aligned with vertical extension 350 such that once vertical extension 350 is adjusted to be vertical (by the leveling mechanisms), a pole 110 attached to vertical extension 350 will also be vertical. In this way, a corner of tube 110 establishes a vertical reference line for use in properly positioning the masonry units. In the example shown, the inside of tube 110 is smooth and the outside of vertical extension 350 is smooth. In other embodiments, one of both of the inside of the tube 110 and the outside of vertical extension 350 has bumps or other protrusions that form a snug fit between tube 100 and vertical extension 350.

Figure 5:
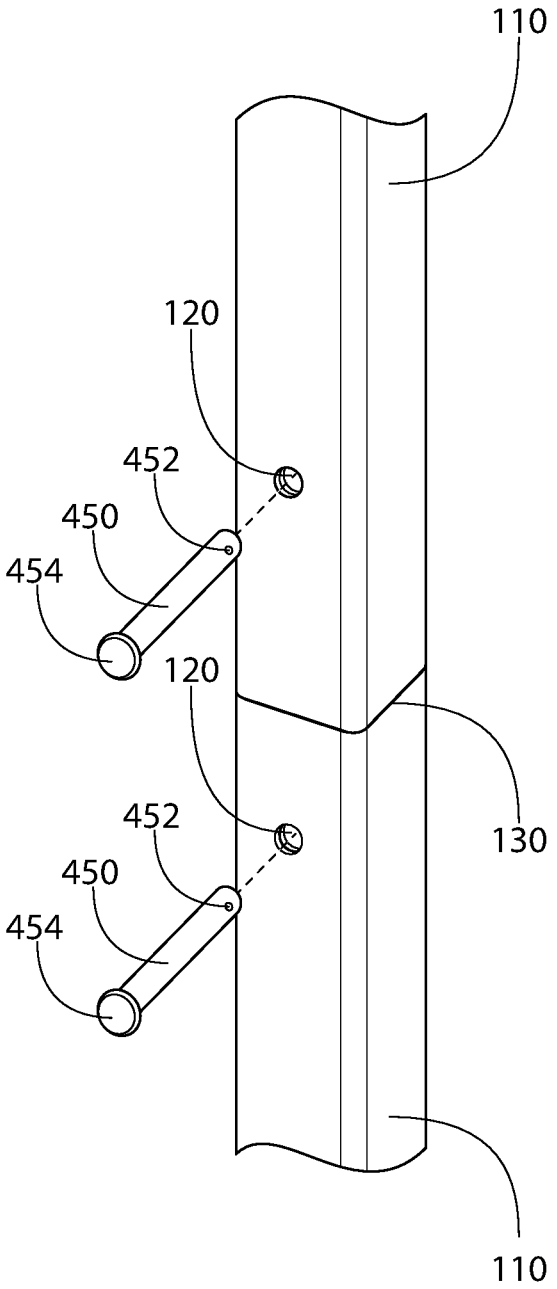
FIG. 5 is a perspective view of two connected poles in accordance with embodiments of the invention.
Figure 6:
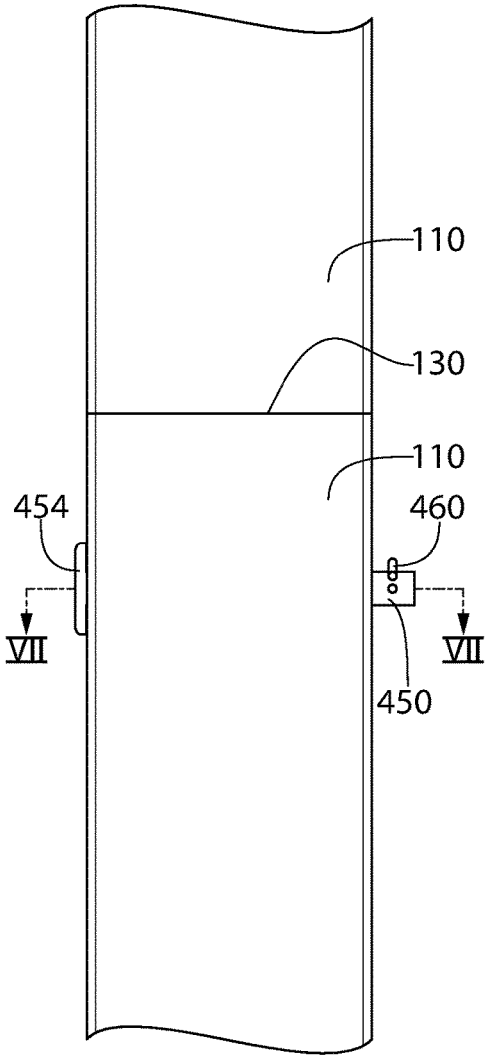
FIG. 6 is a side view of an example of two connected poles in accordance with embodiments of the invention.
Figure 7:
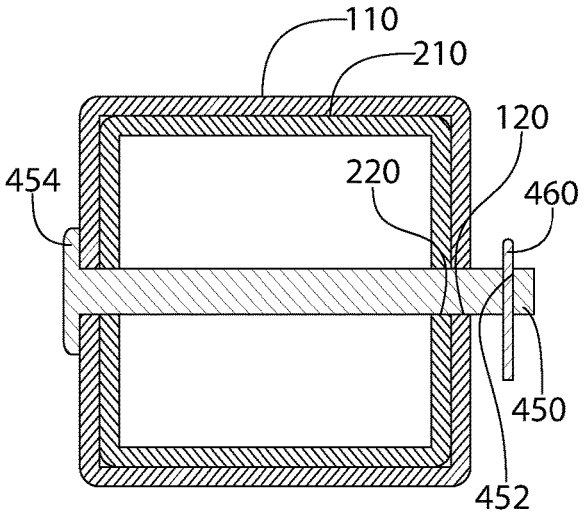
FIG. 7 is a sectional view along section line VII-VII in FIG. 6.

Multiple poles can be supported by base 300 by stacking the poles on top of each other. FIGS. 4-7 show one example of attaching two poles 110 together in accordance with embodiments of the invention. In this example, a coupler 200 is used to couple two poles 110. Coupler 200 has a main body 210, an upper hole 222, and a lower hole 220. Upper hole 222 and lower hole 220 extend horizontally all of the way through coupler 200. In the example shown, main body 210 of coupler 200 is a tube and, as a result, upper hole 222 includes two holes 222 (one through each side of the tube) and lower hole 220 includes two holes 220 (one through each side of the tube). In some embodiments, coupler 200 is solid and, therefore, upper hole 222 is one continuous hole and lower hole 220 is one continuous hole. Upper and lower holes 222, 220 accept pins (described in more detail below) that hold two tubes 110 in place on main body 210. A pin 450 having a head 454 and a hole 452 is positioned through one hole 120, upper hole(s) 222, and the other hole 120 to attach coupler 200 to an upper pole 110. Similarly, a pin 450 having a head 454 and a hole 452 is positioned through one hole 120, lower hole(s) 220, and the other hole 120 to attach coupler 200 to a lower pole 110 (as shown in FIGS. 5-7). A cotter pin 460, wire, or other fastener is located in hole 452 to pins 450 in the holes. In embodiments, the ends of poles 110 are machined or otherwise formed to fit precisely against each other at a joint 130. This precise fit aids in maintaining a collinear alignment of edges of the upper and lower poles 110. In embodiments, coupler 200 is sufficiently long enough and/or coupler 200 fits snuggly inside of poles 110 to maintain a collinear alignment of edges of the upper and lower poles 110. A collinear alignment of at least one edge of each of the upper and lower poles 110 will maintain the correct reference line for use in properly positioning the masonry units.

An example of the use of an exemplary embodiment of the invention will now be described. First, base 300 is positioned as close as possible to a final position and leveled with the leveling mechanisms. A first pole 110 is attached to vertical extension 350 in the lower position as shown in FIG. 3 and then, if necessary, base 300 is moved into the final position and/or releveled to establish a corner (or some other part) of pole 110 as the desired vertical reference line to which the masonry units will be positioned. Alternatively, the first masonry unit can be laid in the proper position and base 300 is positioned relative to the first masonry unit.

Figure 8:
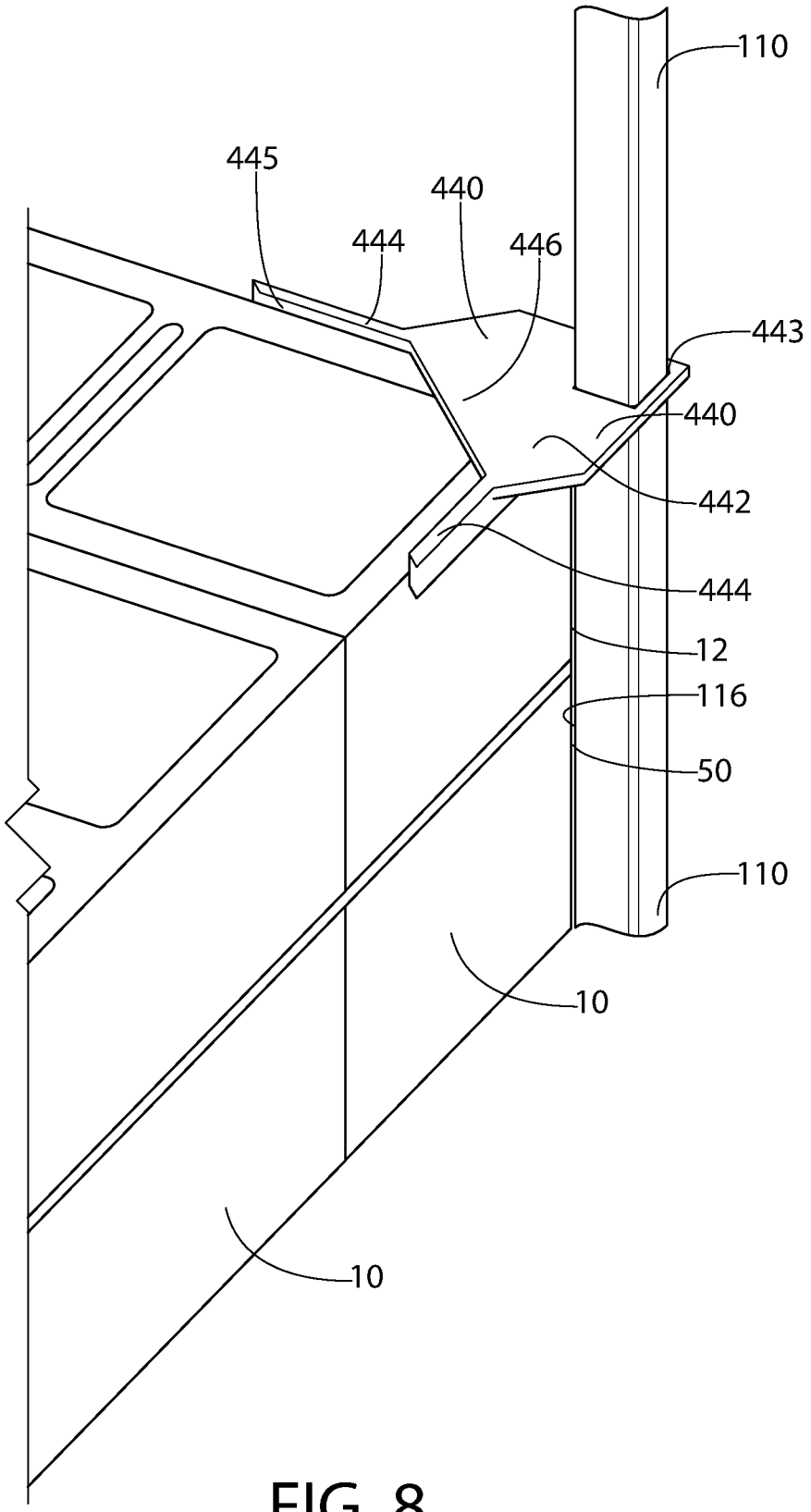
FIG. 8 is a perspective view of an example of a system in accordance with embodiments of the invention.

As shown in FIG. 8, the wall is then constructed by laying masonry units 10 such that a corner 12 of masonry units 10 are positioned a predetermined distance from a corner 116 of pole 110 to form a gap 50. Because pole 110 is vertical due to the proper leveling of base 300, corner 12 of masonry units 10 will also be vertical. It is noted that masonry units can be laid in various configurations. The configurations shown in FIGS. 8-12 are only some examples of possible configurations. It is also noted that although a corner of a masonry wall is used in this example, embodiment of the invention can also be used as a reference line for straight wall sections or other wall sections or other masonry construction.

Figure 9:
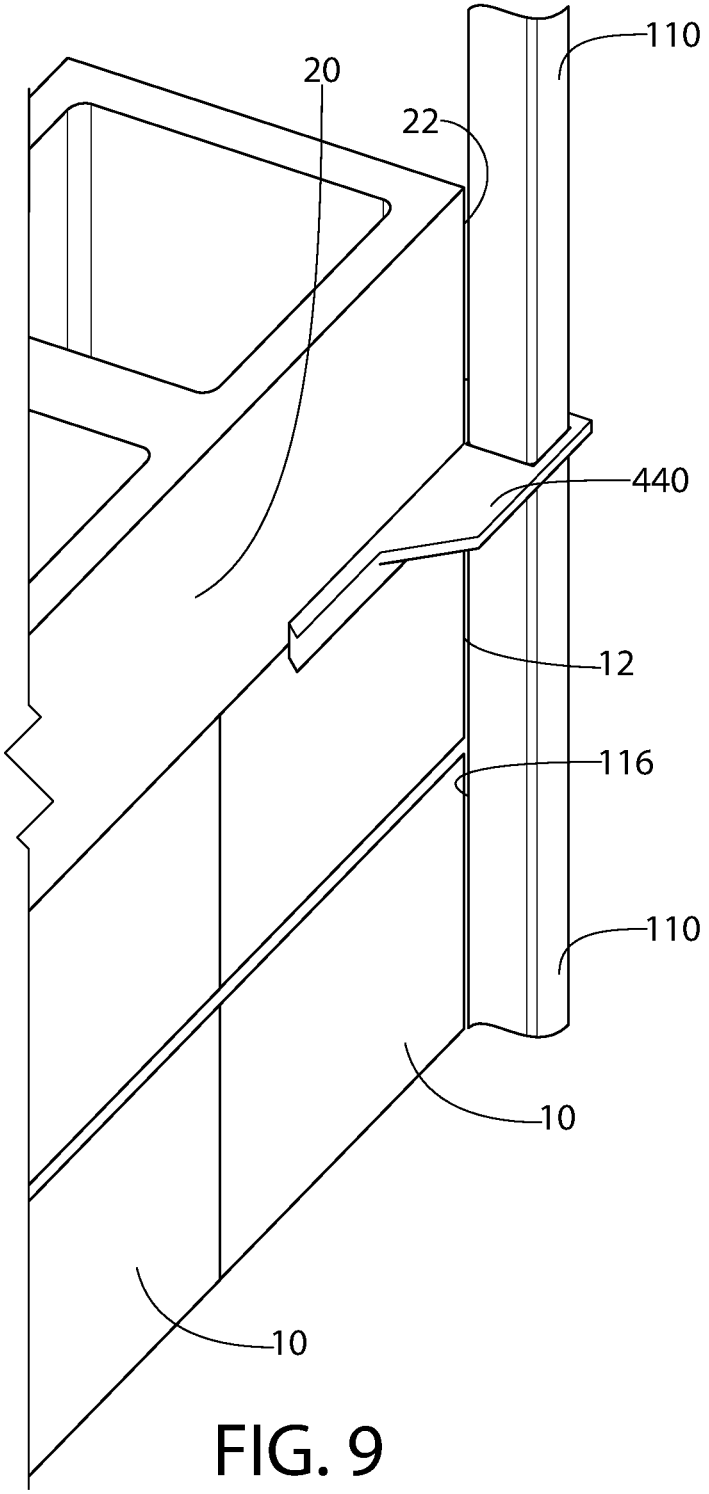
FIG. 9 is a perspective view of an example of a system in accordance with embodiments of the invention.

Referring to FIG. 8, after several courses of masonry units 10 have been laid, a hole 443 in an intermediate attachment bracket 440 is, in this example, slid down over pole 110 to the point where a plate section 442 rests on the top of a corner masonry unit. Inner surfaces 445 of arms 444 that extend from plate section 442 are positioned against outer faces of the corner masonry unit. Mortar (not shown) is then placed on the corner masonry unit and a section 446 of plate section 442 of intermediate attachment bracket 440. A next masonry unit 20 (FIG. 9) is then placed on the mortar and a corner 22 of masonry unit 20 is properly positioned relative to corner 116 of pole 110, as shown in FIG. 9. Intermediate attachment bracket 440 then provides a securing point for pole 110 to the constructed wall. Due to base 300 and intermediate attachment bracket 440, no other securing of pole 110 is needed to maintain a vertical reference line. As stated above, it is often desirable to build some masonry construction, such as, for example, elevator or stair shafts, before any other structure is build near the masonry construction. In these cases, there is no structure to which the top (or other part) of pole 110 can be secured. Embodiments of the invention are particularly useful in these situations. In some situations, use of the invention significantly increases productivity by providing a corner pole reference line where no securing structure other than the masonry wall itself is available.

In some embodiments, hole 443 of intermediate attachment bracket 440 is completely surrounded by material of intermediate attachment bracket 440, while in other embodiments there is an opening in intermediate attachment bracket 440 such that hole 443 is not completely surrounded by material. In some embodiments where there is an opening in intermediate attachment bracket 440 such that hole 443 is not completely surrounded by material, a screw or other clamping mechanism is provided to decrease the size of hole 443 to tightly clamp intermediate attachment bracket 440 to pole 110. In some embodiments, one or more thumb screws or other fasteners are used to secure intermediate attachment bracket 440 to pole 110. In some embodiments, hole 443 fits snugly around pole 110 such that intermediate attachment bracket 440 does not freely move relative to pole 110.

Figure 10:
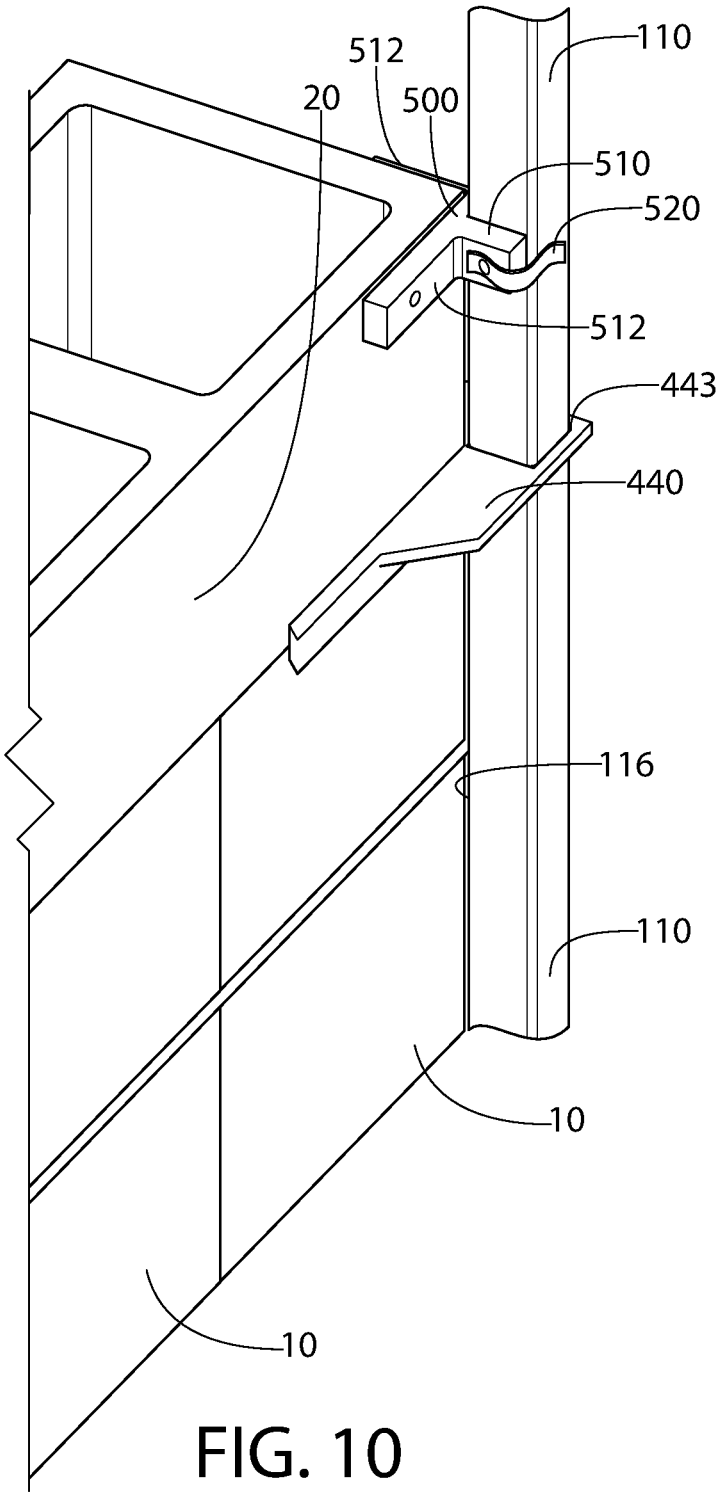
FIG. 10 is a perspective view of an example of a system in accordance with embodiments of the invention.

As shown in FIG. 10, in some embodiments a clipping bracket 500 is used to secure pole 110 to the masonry construction. In this example, clipping bracket 500 includes two arms 512 that are pressed against masonry unit 20, and one or both of arms 512 are fixed to masonry unit 20 by a masonry anchor or other fastening method. A clip 520 presses against pole 110 to secure pole 110 to the masonry construction. In some embodiments, clipping bracket 500 itself (or a plurality of clipping brackets 500) secures pole 110 to the masonry construction. In other embodiments, clipping bracket 500 (or a plurality of clipping brackets 500) presses pole 110 against hole 443 of intermediate attachment bracket 440 to create friction forces that prevent pole 110 from moving relative to intermediate attachment bracket 440 (and thus the masonry construction).

Masonry units are added to the wall until the masonry units approach the top of pole 110. Referring back to FIGS. 3 and 1, the pin is pulled that is located in hole 120 and lower hole 355 to release pole 110 from base 300. Pole 110 is then moved upward to the point where hole 120 aligns with upper hole 365 and the pin is placed through holes 120 and upper hole 365. This places pole 110 in the position shown in FIG. 2, which moves the top of pole 110 upward a distance equal to the distance between lower hole 355 and upper hole 365 (for example, 16 inches or any other appropriate distance).

Figure 11:
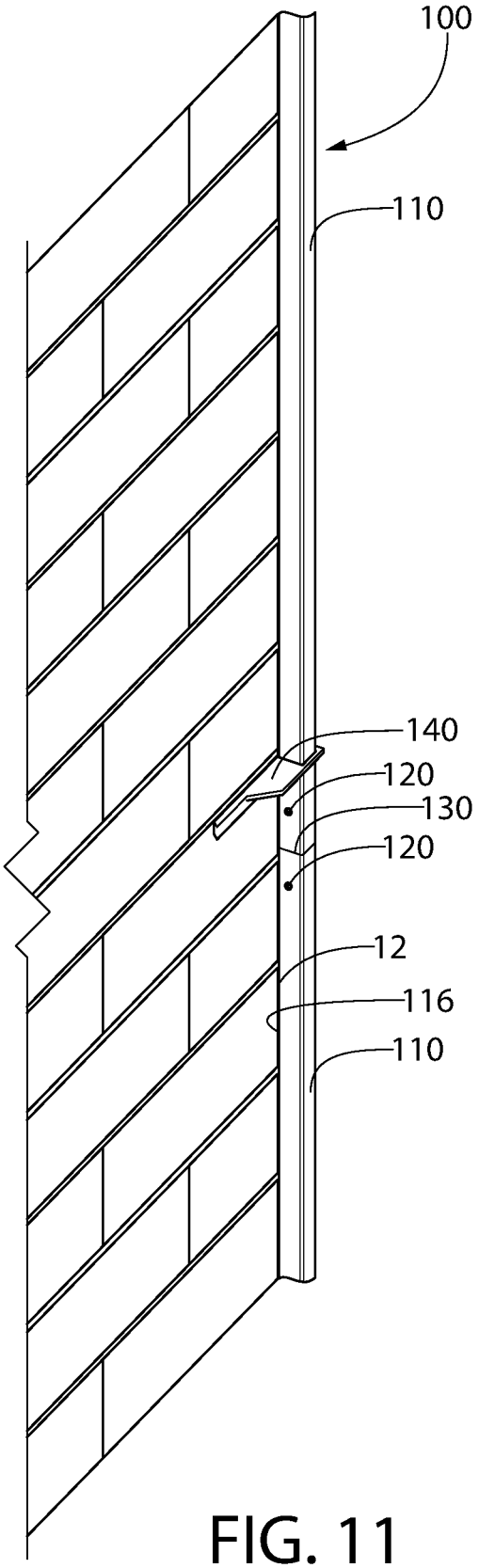
FIG. 11 is a perspective view of an example of a system in accordance with embodiments of the invention.

One or more courses of masonry units can then be added to the construction before reaching the top of pole 110. If the construction (wall) requires more courses of masonry units, another pole 110 can be attached to the top of pole 110 in accordance with, for example, FIGS. 4-7. Construction of additional course of masonry units can then proceed. FIG. 11 shows an example of a wall constructed with an embodiment of the invention using two poles 110. After the upper pole 110 in FIG. 11 is secured with an additional intermediate attachment bracket 440 (above the view of FIG. 11), the lower pole 110 can be removed as follows.

Figure 12:
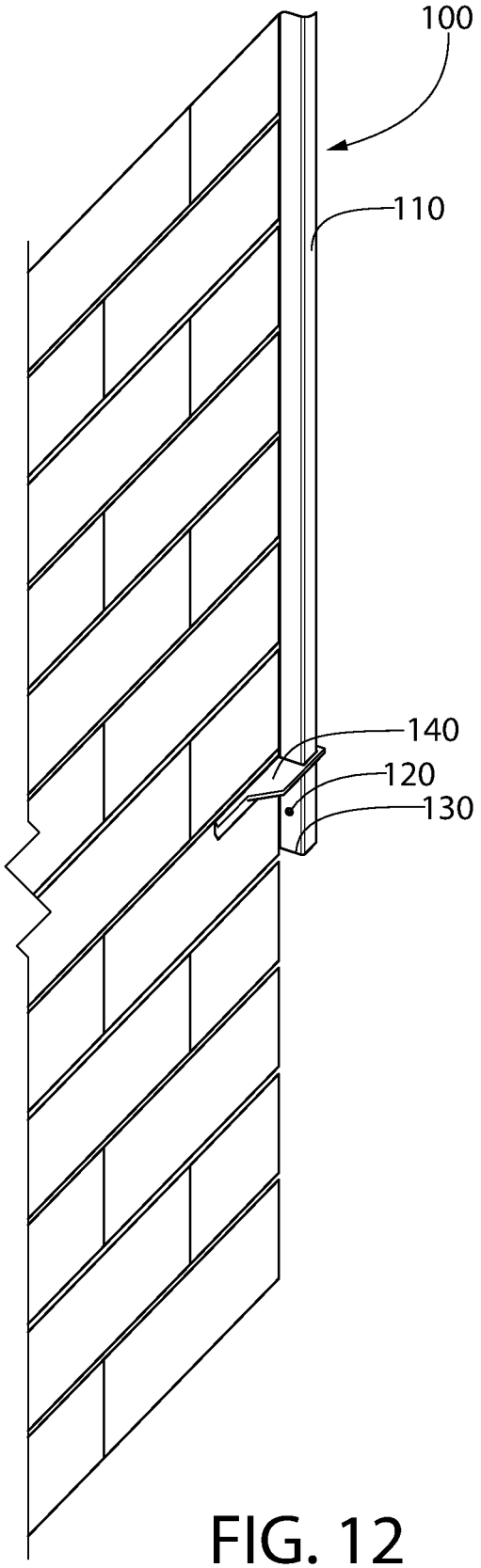
FIG. 12 is a perspective view of an example of a system in accordance with embodiments of the invention with the lower pole removed.

Pin 450 (FIG. 5) in the upper hole 120 of the lower pole 110 in FIG. 11 is pulled out to free lower pole 110 from coupler 200 (and/or pin 450 (FIG. 5) in the lower hole 120 of the upper pole 110 in FIG. 11 is pulled out to free coupler 200 from upper pole 110). This disconnects lower pole 110 from upper pole 110 in FIG. 11. The pin through lower hole 120 in lower pole 110 and upper hole 365 in vertical extension 350 is pulled to disconnect lower pole 110 from vertical extension 350. At this point, lower pole 110 can slide down vertical extension 350 until the bottom edge of lower pole 110 hits base plate 310, creating a distance between the upper edge of lower pole 110 and the lower edge of upper pole 110 sufficient to remove lower pole 110 completely. FIG. 12 shows the invention after lower pole 110 has been removed. In this state, intermediate attachment brackets 440 and/or clipping brackets 500 hold upper pole 110 in place.

The above procedure can be repeated to an unlimited height with a limited number of poles 110 by reusing poles 110 after removal as described above. In addition, once the lowest pole 110 is removed, base 300 can be removed and reused on another wall.

In some embodiments of the invention string holders can be attached to poles 110, intermediate attachment brackets 440, and/or some other part of the invention to hold string used as a horizontal (or other angle) reference line for masonry units.

After (or before) pole 110 has been removed from a particular intermediate attachment bracket 440, intermediate attachment bracket 440 can be removed from the masonry construction by tapping with a hammer or by some other method. Similarly, after (or before) pole 110 has been removed from the masonry construction, a clipping bracket 500 can be removed from the masonry construction by tapping with a hammer or by some other method.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A construction system for establishing alignment of a plurality of masonry building units, the system comprising:

a base having a base plate, a vertical extension extending vertically from the base plate, the vertical extension having a first hole through the vertical extension, and a leveling mechanism that adjusts an orientation of the base plate relative to a surface on which the base is located;

a first pole removably attached to the vertical extension, the first pole having a first end, a second end, and a first hole through the first pole proximate to the first end;

a second pole having a first end and a second end;

a coupler that couples the second pole to the first pole, the coupler having a first portion that extends into the first pole when the first and second poles are coupled by the coupler, and a second portion that extends into the second pole when the first and second poles are coupled by the coupler; and a first attaching member removably attaching the first pole to the vertical extension, the first attaching member being located in the first hole of the vertical extension and the first hole of the first pole when the first pole is in an upper position, wherein a reference edge of the first pole and a reference edge of the second pole are collinear when the second pole is coupled to the first pole by the coupler, the first end of the first pole is closer to the base plate than the second end of the first pole is to the base plate when the first pole is attached to the vertical extension, the first end of the first pole is a second distance from the base plate when the first pole is in the upper position, the first end of the first pole is a first distance from the base plate when the first pole is in a lower position, the second distance is greater than the first distance, and the second distance is greater than a shorter one of the first portion of the coupler and the second portion of the coupler.

2. The system of claim 1, further comprising a second hole through the vertical extension, the second hole located vertically lower on the vertical extension than the first hole, wherein the first end of the first pole is in the lower position when the first attaching member is in the first hole of the first pole and the second hole of the vertical extension.

3. The system of claim 2, further comprising an intermediate attachment bracket having an opening sized to receive the first pole, and a building unit attachment portion that is configured to attach to a first masonry building unit of the masonry building units such that the intermediate attachment bracket is stationary relative to the first masonry building unit.

4. The system of claim 2, further comprising a first coupler attaching member and a second coupler attaching member, wherein the first pole has a second hole through the first pole proximate to the second end of the first pole, the second pole has a first hole through the second pole proximate to the first end of the second pole, the coupler has a first coupler hole through the coupler and a second coupler hole through the coupler, the first coupler attaching member is located in the second hole of first pole and the first coupler hole when the second pole is coupled to the first pole by the coupler, and the second coupler attaching member is located in the first hole of the second pole and the second coupler hole when the second pole is coupled to the first pole by the coupler.

5. The system of claim 4, wherein the first attaching member, the first coupler attaching member, and the second coupler attaching member are interchangeable.

6. The system of claim 4, wherein the first hole in the first pole has a central axis that is perpendicular to a longitudinal axis of the first pole, the second hole in the first pole has a central axis that is perpendicular to the longitudinal axis of the first pole, the first hole in the second pole has a central axis that is perpendicular to a longitudinal axis of the second pole, the first coupler hole has a central axis that is perpendicular to the longitudinal axis of the first pole, the second coupler hole has a central axis that is perpendicular to the longitudinal axis of the second pole, and the longitudinal axis of the second pole and the longitudinal axis of the first pole are collinear.

7. The system of claim 6, wherein the first pole has a uniform cross-sectional shape along its longitudinal axis, the second pole has a uniform cross-sectional shape along its longitudinal axis, and the cross-sectional shape of the second pole is the same as the cross-sectional shape of the first pole.

8. The system of claim 7, further comprising an intermediate attachment bracket having an opening sized to receive the first pole, and a building unit attachment portion that is configured to attach to a first masonry building unit of the masonry building units such that the intermediate attachment bracket is stationary relative to the first masonry building unit.

9. The system of claim 8, wherein the building unit attachment portion is a horizontal plate that is configured to be located between two of the masonry building units and held stationary relative to the two masonry building units with mortar.

10. The system of claim 7, wherein the first pole and the second pole are interchangeable.

11. The system of claim 1, wherein the second distance is greater than one half of the length of the coupler.

12. The system of claim 9, wherein the second distance is greater than one half of the length of the coupler.

13. The system of claim 7, wherein the second distance is greater than one half of the length of the coupler.

14. The system of claim 13, further comprising an intermediate attachment bracket having an opening sized to receive the first pole, and a building unit attachment portion that is configured to attach to a first masonry building unit of the masonry building units such that the intermediate attachment bracket is stationary relative to the first masonry building unit.

15. The system of claim 1, wherein the first pole has a uniform cross-sectional shape along its longitudinal axis, the second pole has a uniform cross-sectional shape along its longitudinal axis, and the cross-sectional shape of the second pole is the same as the cross-sectional shape of the first pole.

16. A base for a construction system for establishing alignment of a plurality of masonry building units, the base comprising:

a base plate, a vertical extension extending vertically from the base plate, the vertical extension having a first hole through the vertical extension, the vertical extension being adapted to receive a first pole and a coupler that couples a second pole to the first pole, the coupler having a first portion that extends into the first pole when the first and second poles are coupled by the coupler, the coupler having a second portion that extends into the second pole when the first and second poles are coupled by the coupler, wherein the vertical extension is adapted to locate a first end of the first pole at a second distance from the base plate when the first pole is in an upper position, the vertical extension is adapted to locate the first end of the first pole at a first distance from the base plate when the first pole is in a lower position, the second distance is greater than the first distance, and the second distance is greater than a shorter one of the first portion of the coupler and the second portion of the coupler; and a leveling mechanism that adjusts an orientation of the base plate relative to a surface on which the base is located.

17. A method of aligning a plurality of masonry building units, the method comprising:

providing a base having a base plate, a vertical extension extending vertically from the base plate, the vertical extension having a first hole through the vertical extension, and a leveling mechanism that adjusts an orientation of the base plate relative to a surface on which the base is located;

removably attaching a first pole to the vertical extension with a first attaching member, the first pole having a first end, a second end, and a first hole through the first pole proximate to the first end, the first attaching member being located in the first hole of the vertical extension and the first hole of the first pole when the first pole is in an upper position;

positioning the base such that an edge of the first pole is a predetermined distance from a predetermined vertical surface of the plurality of building units;

leveling the base by adjusting the leveling mechanism such that the first pole is vertical removably attaching a coupler to the second end of the first pole, the coupler having a first portion that extends into the first pole when the first pole and a second pole are coupled by the coupler, and a second portion that extends into the second pole when the first and second poles are coupled by the coupler;

removably attaching the second pole to the coupler;

positionally securing the second pole to at least one of the masonry building units;

decoupling the coupler from one of the first pole and the second pole; and removing the first attaching member to allow the first pole to move downward from the upper position to a lower position;

wherein a distance between the upper position and the lower position is greater than a shorter one of the first portion of the coupler and the second portion of the coupler.

18. The method of claim 17, further comprising removing the first pole from the vertical extension, and removing the coupler from the second pole, concurrently with the second pole remaining positionally secured to the at least one of the masonry building units.

* * * * *